United States Patent [19]

Swapceinski et al.

[11] 4,442,790

[45] Apr. 17, 1984

[54] MAGNETIC BRUSH DEVELOPMENT APPARATUS

[75] Inventors: John P. Swapceinski, Bergen; Leon A. Rose, Honeoye Falls; Stewart D. Probst, Rush; Donald G. McKeown, Warsaw; Thomas K. Hilbert, Spencerport, all of N.Y.

[73] Assignee: Eastman Kodak Company, Rochester, N.Y.

[21] Appl. No.: 426,577

[22] Filed: Sep. 29, 1982

[51] Int. Cl.[3] ..... G03G 15/09

[52] U.S. Cl. ..... 118/657; 118/658

[58] Field of Search ..... 118/657, 658

[56] References Cited

U.S. PATENT DOCUMENTS

| | | | |
|---|---|---|---|
| 3,543,720 | 12/1970 | Drexler et al. | 118/637 |
| 3,575,505 | 4/1971 | Parmigiani | 355/10 |
| 3,615,406 | 10/1971 | Merrill | 96/1.5 |
| 3,615,414 | 10/1971 | Light | 96/1.6 |
| 3,639,245 | 2/1972 | Nelson | 252/62.1 |
| 3,640,248 | 2/1972 | Nielander | 118/637 |
| 3,654,893 | 4/1972 | Piper et al. | 118/2 |
| 3,674,532 | 7/1972 | Morse | 117/17.5 |
| 3,816,840 | 6/1974 | Kotz | 346/74 ES |
| 3,893,935 | 7/1975 | Jadwin et al. | 252/62.1 |
| 3,911,864 | 10/1975 | Hudson | 118/637 |
| 4,025,186 | 5/1977 | Hunt, Jr. et al. | 355/14 |
| 4,027,621 | 6/1977 | Kane et al. | 118/5 |
| 4,086,006 | 4/1978 | Hauser et al. | 355/3 DD |
| 4,251,154 | 2/1981 | Russel | 355/4 |
| 4,279,942 | 7/1981 | Swapceinski | 427/14.1 |
| 4,292,921 | 10/1981 | Kroll et al. | 118/658 |

FOREIGN PATENT DOCUMENTS 979299 12/1975 Canada .

OTHER PUBLICATIONS

*Research Disclosure Bulletin,* No. 16126, Sep. 1977, McGlen et al., A Toning Station Using Counter Rotating Magnetic Rollers.

*Primary Examiner*—Bernard D. Pianalto
*Attorney, Agent, or Firm*—G. Herman Childress

[57] ABSTRACT

An electrographic development station is disclosed which includes three magnetic brushes which sequentially apply toner to an electrostatic image on a moving photoconductor. The two upstream brushes rotate counter-current with respect to the movement of the photoconductor and have magnetic fields which overlap so that developer is carried from one brush to the other. The third magnetic brush rotates co-current with regard to such photoconductor movement. The two counter-current brushes apply a large quantity of toner to an electrostatic image on the photoconductor and the co-current brush applies a sufficient amount of toner to develop any incompletely developed portions of an electrostatic image.

7 Claims, 6 Drawing Figures

MAGNETIC BRUSH DEVELOPMENT APPARATUS

BACKGROUND OF THE INVENTION

Field of the Invention

The present invention relates to magnetic brush development apparatus which provides improved development of electrostatic images formed on photoconductors, and especially those photoconductors that are moving at a relatively high rate of speed.

In electrography, it is common to form an electrostatic image on an insulating surface of an electrophotographic member in the form of a drum or web. Toner particles are applied to this image to develop it. In many commercial applications, the toner is either transferred in an image-wise configuration to another surface and then fixed or is fixed to the insulation surface itself. In processes in which the toner is transferred from the insulating surface prior to fixing, the insulating surface generally is reused.

Triboelectric developing systems are frequently used in the development of electrostatic images. In such systems, finely divided toner particles are held to the surface of much larger carrier particles by electrostatic charges created by triboelectrification, forming a mixture (herein called a developer). When the developer is brought into contact with an electrostatic image, the charge on the image attracts the triboelectrically charged toner and overcomes the attraction of the carrier for the toner thereby developing the image.

Among triboelectric developing apparatus, the most commonly used are cascade apparatus and magnetic brush apparatus. In cascade apparatus, gravity is used to roll developer across the image. Because cascade apparatus use gravity as their primary moving force, they generally are used in low-speed copiers. One reason for this is that in a high-speed copier, a cascade apparatus would require substantial space to effectively tone electrostatic images.

In magnetic brush apparatus which use a developer having carrier and toner particles, the carrier particles are ferromagnetic in nature. These ferromagnetic carrier particles are held to an applicator surface, for example, a nonmagnetic cylinder, in a bristle formation, by magnets located inside the cylinder. The bristles are brushed across a surface carrying an electrostatic image. The electrostatic attraction between the toner and the charged image overcomes the triboelectrically created attraction between toner and ferromagnetic particles and the image is developed. Areas of the image exerting less attractive force on the toner than is exerted by the carrier are cleaned of toner as they are brushed. Magnetic brush apparatus also may use a single component developer such as is disclosed in U.S. Pat. No. 3,816,840 issued June 11, 1974 to Kotz.

Dual magnetic brush apparatus such as shown in commonly assigned U.S. Pat. No. 3,543,720 to Drexler et al, and in U.S. Pat. No. 3,640,248 to Nielander include two magnetic brushes or rollers which rotate counter-current with respect to the movement of a web-type photoconductor. Developer is transported from the transport or downstream brush to the upstream or development brush. In this way, a large surface area of developer (sometimes referred to as a footprint) is presented to an electrostatic image and large quantities of toner are available for image development. The particular arrangement has performed quite satisfactorily; however, as copier speeds increase, it suffers from the flaming problem. Flaming is when the leading edge of a large solid area is not fully developed. Flaming is related to the velocity of moving photoconductors. It has been determined that as the photoconductor velocity increases, flaming increases. A discussion of flaming is set forth in some detail in commonly assigned U.S. Pat. No. 4,292,921 to Kroll et al. As is disclosed in the Kroll et al patent and also in Research Disclosure No. 16126 (September 1977), a counter-current brush preceeded by a co-current brush can reduce flaming. Unfortunately, when development of an electrostatic image on a high-speed photoconductor is needed, these brushes may not apply sufficient toner to such image to uniformly develop large solid areas.

In order to enhance development of electrostatic latent images, reduce flaming, and increase development of large solid images moving at high speed, many magnetic brush development apparatus include four or more brushes. See, for example, U.S. Pat. No. 3,911,864 where the magnetic brushes rotate in alternate directions, and U.S. Pat. Nos. 4,027,621, and 4,086,006, where all magnetic brushes rotate co-current.

SUMMARY OF THE INVENTION

The present invention pertains to providing a magnetic brush apparatus with a minimum number of magnetic brushes which reduces flaming and yet develops large solid areas when photoconductors are moving at a relatively high rate of speed. Magnetic brush apparatus in accordance with the invention are suitable for use in both black and white copiers and in color copiers which have multiple magnetic brush apparatus such as shown in commonly assigned U.S. Pat. No. 4,251,154 entitled "Electrophotographic Color Copier" issued Feb. 17, 1981 to Russel.

The preferred embodiment includes a magnetic brush apparatus having three magnetic brushes. The two upstream brushes rotate counter-current with respect to the movement of the photoconductor and have overlapping magnetic fields so that developer is carried from one brush to another. Downstream from these brushes there is provided a third magnetic brush which rotates co-current with respect to the photoconductor movement. The two counter-current brushes apply a large quantity of toner to an electrostatic image moving on a high-speed photoconductor. This toner develops large solid image areas while the co-current brush applies sufficient toner to develop any incompletely developed portions of an electrostatic image, especially the leading edge of large solid areas.

DESCRIPTION OF THE PREFERRED EMBODIMENT

Figure 1:
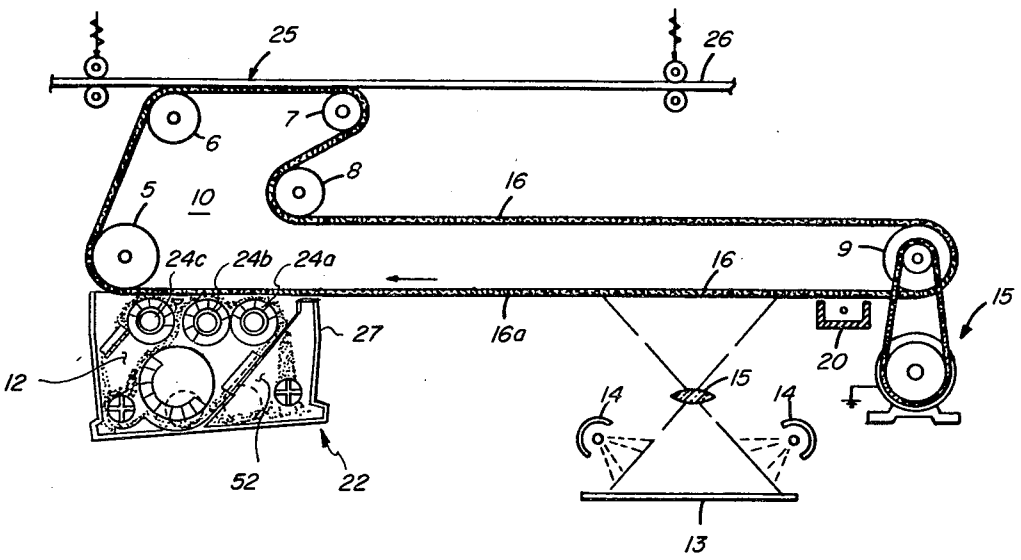
FIG. 1 is a schematic vertical section of a copier apparatus embodying the magnetic brush.

For a general understanding of a web-type electrographic reproducing or copier apparatus 10 wherein the invention has utility, reference is made to FIG. 1. As shown, a photoconductor member, in the form of a web 16, is trained about rollers 5 through 9 with the roller 9 being driven by a drive mechanism 15 shown for simplicity to include a motor-pulley arrangement. An insulating layer 16*a* of the web 16 is uniformly charged at a charging station 20. Thereafter, an information medium 13 such as a document is illuminated by radiation from flash lamps 14. Such radiation is reflected from the medium and projected by a lens 15 onto the charged insulating surface 16*a* of the web 16, to selectively dissipate charge and form an electrostatic image of medium 13 on the web. For more specific disclosures of the web construction, see commonly assigned U.S. Pat. Nos. 3,615,406 and 3,615,414, both issued Oct. 31, 1971.

The apparatus 10 further includes a magnetic brush apparatus 22 at which the moving electrostatic image is contacted with finely divided charged toner particles that adhere to the charged web surface in a configuration defined by the electrostatic image, to form a visible toner image; a transfer station 25 in which the toner image is transferred to a receiving surface of a copy sheet 26 on which it can be subsequently permanently fused; and a cleaning station (not shown) in which residual toner particles are removed from the web 16. For a more complete description of the general organization of a similar copier apparatus, reference may be made to commonly assigned U.S. Pat. No. 4,025,186, issued May 24, 1977 to Hunt et al.

Figure 3:
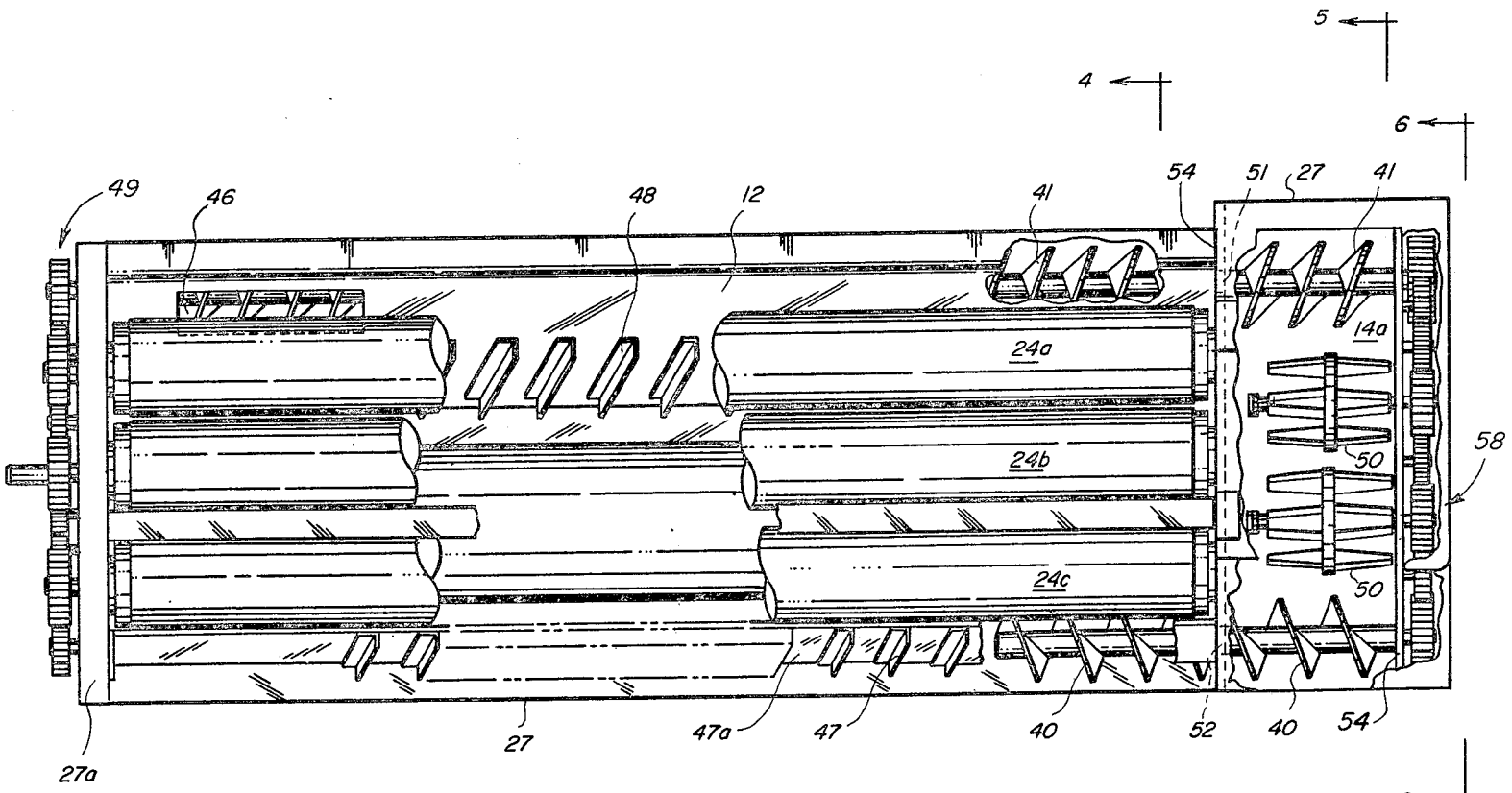
FIG. 3 is a top plan view of the magnetic brush apparatus.
Figure 5:
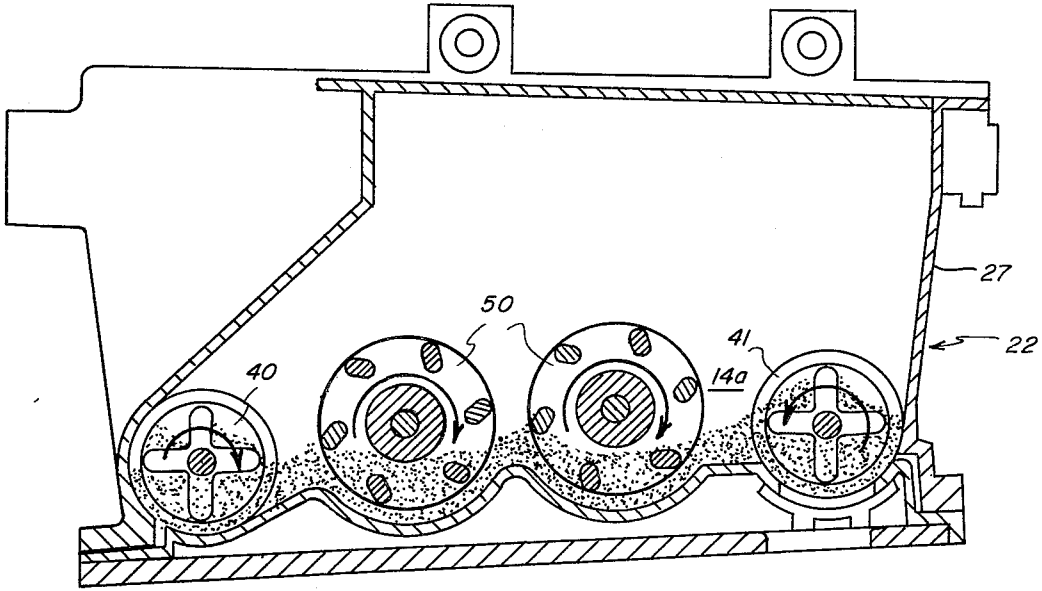
FIG. 5 is a cross-sectional view taken along the lines 5—5 of FIG. 3.

An electrostatic image on the insulating surface 16*a* of web 16 is moved past three magnetic brushes or rollers 24*a*, 24*b*, and 24*c* mounted in a development station 12 of a housing 27 which holds a supply of developer consisting of a mixture of toner and carrier particles. The housing 27 also includes a sump 14*a* (FIGS. 3 and 5). The carrier particles are made of a magnetic material such as iron. Simply stated, a magnetic material is one which a magnet attracts. The toner particles are finely divided and are held to the surface of much larger carrier particles by electrostatic charges created by triboelectrification caused by mixing paddle wheels 50 and augers 40 and 41 in the sump 14*a*. For a specific example of such a developer, see commonly assigned U.S. Pat. No. 3,893,935, issued July 8, 1975 to Jadwin et al.

Figure 2:
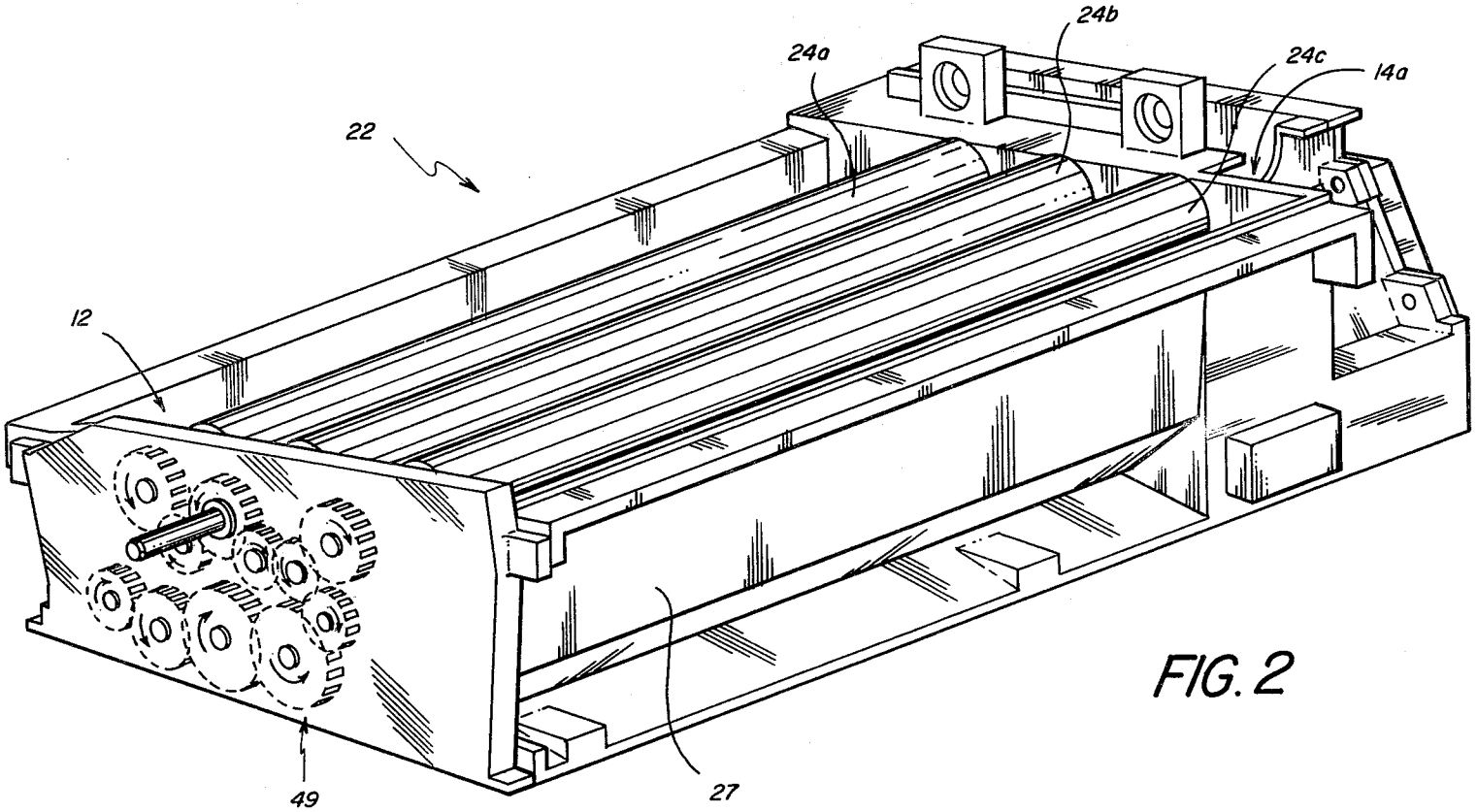
FIG. 2 is a pictorial perspective of the magnetic brush apparatus shown in FIG. 1.
Figure 4:
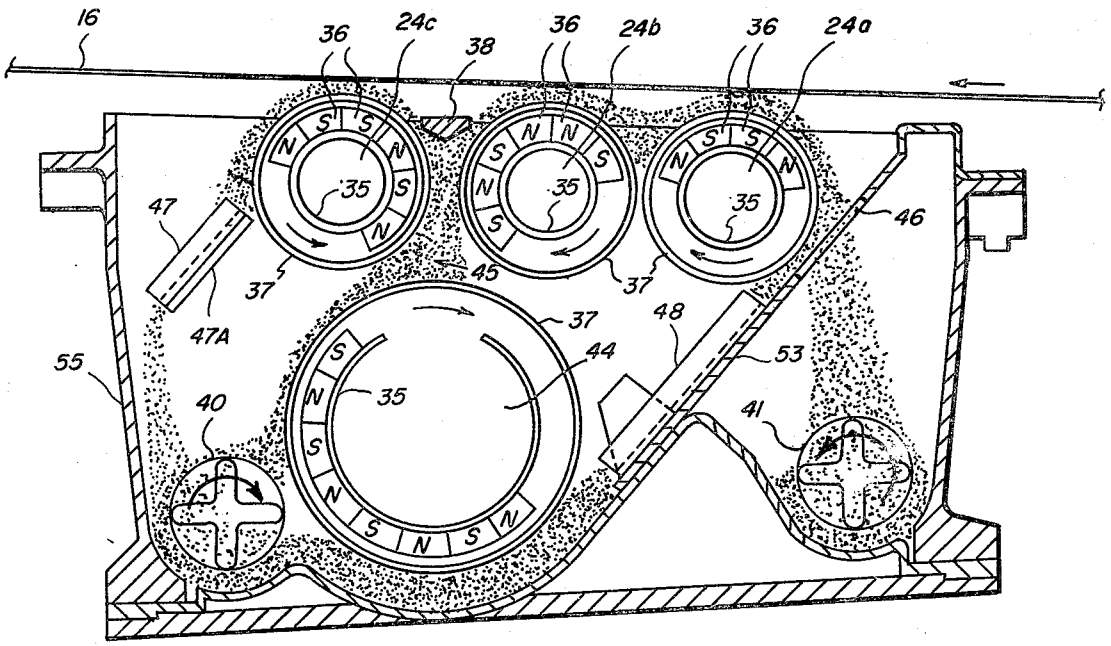
FIG. 4 is a cross-sectional view taken along the lines 4—4 of FIG. 3.

The brushes 24*a*, 24*b*, and 24*c* can be constructed according to any one of a variety of designs known in the prior art. A preferred configuration shown in FIG. 4 includes a stationary tubular magnetic pole piece 35 formed of soft steel or other magnetic material. Mounted around part of the circumference of the pole piece 35 are permanent magnets 36, formed for example of a rubber bonded barium ferrite strips. Concentric with these magnets 36 and on the outside thereof, is a rotatable, preferably grooved, hollow, non-magnetic, applicator cylinder 37. The cylinder 37 may be made of aluminum. As each cylinder 37 is rotated by a gearing arrangement 49 shown in FIG. 2, developer is held on its surface and moves with the cylinder while in the field of internal magnets 36.

The magnetic field from these internal magnets 36 attract the carrier particles and cause the developer to form on the cylinder a nap or coating which appears like a fine-bristled brush. The web is lightly pressed against these bristles, and the bristles supply toner particles to the electrostatic images on the web 16. The brushes 24*a*, 24*b* and 24*c* are similar in construction to the magnetic brushes disclosed in commonly assigned U.S. Pat. No. 3,543,720, issued Dec. 1, 1970 in the names of Drexler et al.

When the developer is brought into contact with an electrostatic image, the charge on the image overcomes the attraction of the carrier for the toner and causes toner to transfer from the bristles to the image. In this process, toner is removed from the developer and carried away on the web 16 for later transfer to copy paper 26. The magnets 36 in brushes 24*a* and 24*b* are arranged so that their magnetic fields overlap to cause developer to be carried from brush 24*b* to brush 24*a*. Between brushes 24*b* and 24*c*, there is provided a skive 38 which meters developer to brushes 24*b* and 24*c*. The skive 38 clips the tops of the bristles and is positioned so that the brushes present optimum lengths of bristles to the web 16 for image development. The counter-current brush 24*c* is similar in construction to brushes 24*a* and 24*b* having a pole piece 35, magnets 36 and an applicator cylinder 37. It has been found preferable to have the diameter of the applicators 37 of all three brushes be of the same diameter and rotate at the same angular velocity. For a specific example with the photoconductor moving at about 15 inches/second it may be desirable to have the peripheral speed of all three applicators 37 move at about 30 inches/sec. Counter-current brushes 24*a* and 24*b* present many more bristles of developer to an electrostatic image than does co-current brush 24*a*, since there is a difference in the relative velocity between the image and bristles of brushes 24*a* and 24*b* of about 45 inches/sec. while between brush 24*c* and the image it is only about 15 inches/sec.

A fourth magnetic brush 44 is also similar in construction to brushes 24*a*, 24*b* and 24*c*. Its applicator cylinder 37 rotates in the same direction as brushes 24*a* and 24*b*. Magnetic brush 44 supplies developer to a pickup zone 45 between brushes 24*b* and 24*c*. Although not set forth in the drawings, it will be understood that the brushes 24*a*, 24*b* and 24*c* preferably should be electrically biased to reduce background development. In a preferred mode of operation the same bias level is applied to brushes 24*a* and 24*b* and this bias voltage is significantly less than that of the downstream brush 24*c*. For a specific example, with an electrostatic image of −500 volts, it has been found desirable to bias both upstream rollers at −50 volts and the downstream roller at −250 volts. A discussion of biasing of brush rollers is set forth in column 6, line 64–68 and column 7, line 1–60 of the above referred to Kroll et al U.S. Pat. No. 4,292,921. For other disclosures of biasing of magnetic brushes, see commonly assigned U.S. Pat. Nos. 3,575,505, 3,654,893, 3,674,532, and 4,279,942. See also Canadian Pat. No. 979,299.

Figure 6:
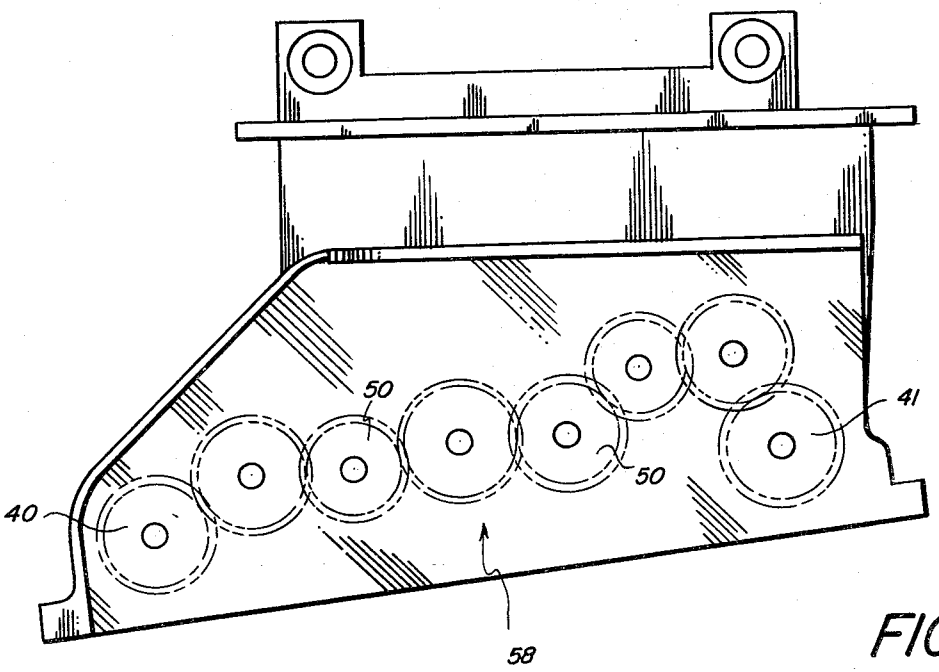
FIG. 6 is a view taken along the lines 6—6 of FIG. 3.

The sump 14*a* shown in FIGS. 3 and 5 is disposed between walls 54 at one end of the development station 12. The sump 14*a* contains two mixing wheels 50 and end portions of augers 40 and 41 which mechanically mix the toner as it is added into the developer. The mixing paddle wheels 50 also move the developer from the return auger 41 to the feed auger 40. Wheels 50 are mounted in sleeve bearings at one end wall 54 of the sump. The drive means for the magnetic brushes includes a drive motor (not shown) for driving the brushes 24*a*, 24*b*, 24*c* and 44 by means of the gear train 49 connected to such motor (at the front of development station in FIG. 1). The gear train 49 also drives the return auger 41. In the sump 14a adjacent to wall 54 there is a second gear train 58 (FIGS. 3 and 6) which is driven by the return auger 41. Gear train 58 transmits power from the return auger 41 to the wheels 50 and the feed auger 40. For example of another similar gearing arrangement, see FIG. 2 of the aforementioned U.S. Pat. No. 3,543,720.

Both of the augers 40 and 41 are elongated helical members which may be made of molded plastic or from metal such as case aluminum or other nonmagnetic material. As shown in FIG. 5, the feed auger 40, is located near the bottom left-hand portion of the sump 14a. In the sump 14a, the auger 40 mixes developer and newly added toner and move developer through a passageway 52 formed in a wall 54 from the sump 14a to the developer station 12. The auger 40 rides in sealed bearings (not shown) in the end walls 27a and 54. The auger 40 extends only a short distance into the development station and supplies developer to the front of the supply brush 44.

The return auger 41 (see FIGS. 3 and 4) receives developer from brush 24a. The developer from brush 24a is delivered to auger 41 through a port 46 in the developer station wall 53 and is returned to the sump through a passageway 51 in a wall 54 of station 12.

As noted above, the developer consists of carrier particles and toner particles. The carrier particles transport the much smaller toner particles to the web 16. In developing electrostatic images, toner is constantly removed from the developer and carried away on the web for later transfer to copy paper 26. The carrier particles are retained in the developer for reuse. A toner replenishment mechanism (not shown) will be understood to be secured to the top opening of the sump 14a. From time to time it adds measured amounts of fresh toner to the developer in the sump to maintain a proper concentration of toner and carrier particles.

In the development station 12 (see FIG. 4), two separate series of deflection vanes 47 and 48 are provided. Vanes 47 are mounted on a plate 47a secured to walls 54 and 27a and vanes 48 are mounted on the wall 53. These vanes 47 and 48 are respectively disposed adjacent to brushes 24c and 24a. These deflection vanes divert flowing developer exiting from these brushes toward the wall 55 of the station 12 utilizing only the forces of momentum and gravity and thereby eliminate the need for a full-length feed auger. This reduces the wear and tear on the developer, and the complexity of the hardware. The use of vanes 47 and 48 also establishes a transitional flow component that is a function of vane angle, gaps between the skive 38 and brushes 24b and 24c respectively, and speed of the brushes 24a, b and c. By carefully selecting the various components and operating parameters of the apparatus 22, the exit flow at port 46 can be held relatively constant.

The circulation of the developer in the apparatus will now be explained. Starting in the sump 14a, developer is moved by the feed auger 40 into the development station 12 adjacent to the front portion of the brush 44. It is picked up by the applicator 37 of the brush 44 and delivered to the pickup zone 45. In the pickup zone 45 the carrier particles are attracted by the magnets inside the brushes 24b and 24c to their applicators 37. The developer is moved upward into contact with the skive 38 where it is separated into two flow paths. In the first path the developer is carried into contact with the photoconductor by the brushes 24b and 24a. After developer bristles exit from contact with the photoconductor, they move into a space where there are no magnets and fall to where they are guided by vanes 48 with a translational component of movement directed towards the brush 44. Developer is then picked up by the brush 44 and returned to the pickup zone 45 but at a distance incremented from where it was initially delivered. In the second path, developer is attracted to the applicator 37 of the brush 24c and rotated until at a position where there are no magnets. It falls downwardly onto vanes 47 which increments the developer again towards the wall 55. This developer is also picked up and moved by the brush 44 into the pickup zone 45. The above process is repeated until near the wall 27a (see FIG. 3) developer from the brush 24a falls through the port 46 in the wall 53 into the return auger 41. The return auger 41 moves the developer into the sump. In the sump, the paddle wheels 50 mix the developer with any fresh toner and feed the refreshed developer to the feed auger 40. The above process is then repeated.

The invention has been described with particular reference to a preferred embodiment thereof, but it will be understood that variations and modifications can be effected within the spirit and scope of the invention. For an example, the photoconductor has been described as an endless web, but photoconductive sheets can also be used. For another example, the developer has been described as a two-component (toner and carrier) developer, but the invention may be practiced with a single component developer, a specific example of which is set forth in commonly assigned U.S. Pat. No. 3,639,245 issued Feb. 1, 1972 to Nelson. In such a case, there may be no need to have a return auger or paddle wheels.

What is claimed is:

1. In a development apparatus having three magnetic brushes which sequentially apply toner to an electrostatic image on a moving image-bearing member, the improvement comprising:

(a) means for rotating the two upstream brushes counter-current with respect to the movement of the image-bearing member, said upstream brushes having overlapping magnetic fields for transporting developer from one brush to the other while the developer contacts an electrostatic image on such image-bearing member; and (b) means for rotating the downstream brush co-current with respect to the movement of the image-bearing member to develop any incompletely developed portions of such electrostatic image.

2. In a magnetic brush apparatus for applying toner to a moving photoconductor carrying an electrostatic image by contacting said photoconductor with a developer having a magnetic component, said apparatus including two upstream and one downstream magnetic brushes with each such brush having a hollow, nonmagnetic rotatable, cylindrical applicator and magnetic field producing means located inside each said applicator for producing a magnetic field which acts upon said magnetic component and causes said developer to be carried by said applicator, the improvement comprising:

(a) means for rotating the applicators of the two upstream brushes counter-current with respect to the photoconductor movement and said magnetic field producing means inside the upstream brushes producing fields which overlap so that developer is carried from one of such upstream brushes to the other to thereby apply a large quantity of developer to an electrostatic image on the moving photoconductor;

(b) said third brush being disposed downstream from the first and second brushes and means for rotating its applicator co-current with respect to the photoconductor movement for applying an amount of developer sufficient to develop any incompletely developed portions of the electrostatic image; and (c) means for supplying developer to said brushes.

3. The invention as set forth in claim 2, wherein said developer supplying means includes a fourth magnetic brush for delivering developer between said upstream and downstream brushes.

4. The invention as set forth in claim 2, including a skive disposed between said second and third brush for separating the flow of developer into two flow paths.

5. In a magnetic brush apparatus for applying toner to a moving photoconductor carrying an electrostatic image by contacting said photoconductor with a developer having toner and magnetic particles, said apparatus including a housing defining a development station including two upstream and one downstream magnetic brushes which sequentially contact with developer an electrostatic image, each such brush having a hollow non-magnetic rotatable cylindrical applicator and magnetic field-producing means disposed within each said applicator for producing a magnetic field which acts upon said magnetic component and causes developer to be carried by said applicator, the improvement comprising:

(a) means for rotating the applicators of the two upstream brushes counter-current with respect to the photoconductor movement and said magnetic field-producing means inside the upstream brushes producing fields which overlap so that developer is carried from one of such brushes to the other to thereby apply a large quantity of developer to an electrostatic image on the moving photoconductor;

(b) said third brush being disposed downstream from the first and second brushes and means for rotating its applicator co-current with respect to the photoconductor movement for applying an amount of developer sufficient to develop any incompletely developed portions of the electrostatic image;

(c) means for feeding developer to a pick-up zone between said upstream and downstream brushes; and (d) a plurality of deflection vanes disposed in said development station for receiving developer from said brushes after it has contacted said photoconductor and for circulating such developer to said developer feeding means.

6. The invention as set forth in claim 5 includes a skive disposed between said second and third brushes for separating the flow of developer into two flow paths.

7. The invention as set forth in claim 5, including a sump and means for circulating developer from sump to said developer feeding means.

* * * * *